US010548370B2

(12) United States Patent
Walsh et al.

(10) Patent No.: US 10,548,370 B2
(45) Date of Patent: Feb. 4, 2020

(54) SHOE SOLE CONSTRUCTION

(71) Applicant: The Rockport Company, LLC, Newton, MA (US)

(72) Inventors: James Walsh, Melrose, MA (US); Darrell Forbes, Brentwood, NH (US); Jason Nevens, Milford, MA (US)

(73) Assignee: Rockport IP Holdings, LLC, Newton, MA (US)

( * ) Notice: Subject to any disclaimer, the term of this patent is extended or adjusted under 35 U.S.C. 154(b) by 55 days.

(21) Appl. No.: 15/908,053

(22) Filed: Feb. 28, 2018

(65) Prior Publication Data

US 2019/0261737 A1 Aug. 29, 2019

(51) Int. Cl.

| | |
|---|---|
| ***A43B 13/18*** | (2006.01) |
| ***A43B 7/32*** | (2006.01) |
| ***A43B 13/12*** | (2006.01) |
| *A43B 13/04* | (2006.01) |

(52) U.S. Cl.

CPC ..... *A43B 13/183* (2013.01); *A43B 7/32* (2013.01); *A43B 13/127* (2013.01); *A43B 13/18* (2013.01); *A43B 13/185* (2013.01); *A43B 13/04* (2013.01)

(58) Field of Classification Search

CPC ..... A43B 13/18; A43B 13/185; A43B 13/20; A43B 13/127; A43B 13/181

USPC ..... 36/28, 29

See application file for complete search history.

(56) References Cited

U.S. PATENT DOCUMENTS

| | | | | | |
|---|---|---|---|---|---|
| 2,100,492 | A | * | 11/1937 | Sindler | A43B 13/20 36/29 |
| 4,000,566 | A | | 1/1977 | Famolare, Jr. | |
| 4,782,603 | A | * | 11/1988 | Brown | A43B 13/181 36/28 |
| 4,887,367 | A | | 12/1989 | Mackness et al. | |
| 4,918,838 | A | | 4/1990 | Chang | |
| 5,005,300 | A | * | 4/1991 | Diaz | A43B 1/0072 36/114 |
| 5,117,566 | A | * | 6/1992 | Lloyd | A43B 13/206 36/28 |
| D334,463 | S | | 4/1993 | Chang | |
| 5,595,003 | A | * | 1/1997 | Snow | A43B 13/181 36/27 |

(Continued)

FOREIGN PATENT DOCUMENTS

| | | | |
|---|---|---|---|
| CN | 204048265 | U | 12/2014 |
| CN | 105595514 | A | 5/2016 |

*Primary Examiner* — Marie D Bays

(74) *Attorney, Agent, or Firm* — St Onge Steward Johnston & Reens LLC

(57) ABSTRACT

A shoe sole includes a footbed, a midsole, and an outsole. The footbed includes deformable semi-tubular elements that protrude downward and are received in corresponding trough-shaped cavities of the midsole, which provide cushioning when the semi-tubular elements are compressed under load, and also provide a spring return effect. The semi-tubular elements may have a depth greater than a depth of a corresponding trough shaped cavity whereby the footbed is held in a raised position above the top surface of the midsole. The separation between the footbed and the top surface of the midsole is smaller in forefoot area and greater in the heel area. The separation provides shock absorption and resilience in the shoe because it allows the semi-tubular elements to deform under load and absorb impact shocks.

25 Claims, 5 Drawing Sheets

(56) References Cited

U.S. PATENT DOCUMENTS 5,619,809 A * 4/1997 Sessa ..... A43B 7/06 36/28
5,686,167 A * 11/1997 Rudy ..... A43B 13/189 36/29
6,041,519 A 3/2000 Cheng
6,209,226 B1 4/2001 Squadroni
6,405,456 B1 6/2002 Nichelson
6,568,102 B1 5/2003 Healy et al.
7,153,560 B2 12/2006 Hofmann
7,685,743 B2 3/2010 Swigart et al.
8,590,179 B2 * 11/2013 Sink ..... A43B 13/145 36/103
8,806,782 B2 8/2014 Sun
9,055,782 B2 6/2015 McDonnell
2002/0144426 A1 * 10/2002 Chen ..... A43B 7/081 36/3 B
2004/0154189 A1 * 8/2004 Wang ..... A43B 13/026 36/28
2005/0241180 A1 11/2005 Squadroni
2006/0277792 A1 * 12/2006 Schoenborn ..... A43B 7/08 36/28
2007/0113425 A1 * 5/2007 Wakley ..... A43B 13/20 36/28
2008/0184600 A1 * 8/2008 Yang ..... A43B 1/0045 36/3 B
2008/0289224 A1 * 11/2008 Sink ..... A43B 13/145 36/103
2009/0139114 A1 6/2009 Malek
2010/0024246 A1 2/2010 Park
2011/0138653 A1 6/2011 Corbett
2011/0277346 A1 * 11/2011 Peyton ..... A43B 13/20 36/29
2012/0073162 A1 3/2012 Guirado Martinez
2013/0152429 A1 6/2013 Sink
2014/0020264 A1 1/2014 Holt
2014/0130269 A1 * 5/2014 Dabah ..... A43B 13/181 12/142 R
2014/0259743 A1 * 9/2014 Bernhard ..... A43B 13/181 36/28
2014/0259748 A1 * 9/2014 Bernhard ..... A43B 13/16 36/29
2016/0021974 A1 * 1/2016 Schindler ..... A43B 13/223 36/103
2017/0035146 A1 2/2017 Peyton
2017/0332727 A1 11/2017 Beck et al.

* cited by examiner

SHOE SOLE CONSTRUCTION

FIELD OF THE INVENTION

The present invention is in the field of footwear, and provides a shoe sole construction having both cushioning and energy return.

BACKGROUND OF THE INVENTION

The human foot daily encounters a variety of impact forces as a consequence of individual activity. Activities such as standing, walking, running, and jumping exert forces on an individual's feet that can cause soreness, fatigue, and injury.

Many different theories as to the optimum support and cushioning in a shoe design have been suggested in the past. The most common view however is that an average consumer will benefit from an appropriate amount of arch support, along with resiliency and cushioning in the shoe sole. A properly designed shoe will allow the consumer to be on their feet for long period of time without discomfort or pain.

A number of shoe designs providing shock absorption and/or resiliency have been proposed. These include soles containing springs, gels, or foams that store energy during compression and return energy during expansion. However, these solutions can increase weight or cost of the shoe and may have an unnatural feel.

Thus, there continues to be a need for a shoe sole construction that provides improved cushioning, energy return, and responsiveness throughout the life of the shoe.

SUMMARY OF THE INVENTION

Accordingly, embodiments of the invention include a shoe sole construction that provides a user with improved cushioning and energy return. In one embodiment of the invention, a shoe sole including a footbed, a midsole, and an outsole is provided. The footbed has a top layer, a middle layer, and a bottom layer. The bottom layer of the footbed includes a plurality of deformable semi-tubular elements that are arranged transversely to a longitudinal axis of the shoe sole and protrude downward from the middle layer of the footbed to the midsole. The midsole has a top surface and a bottom surface. The top surface of the midsole includes a plurality of trough-shaped cavities that are arranged transversely to the longitudinal axis of the shoe sole and correspond to the plurality of semi-tubular elements such that the semi-tubular elements nest in the trough-shaped cavities. Additionally, the outsole includes at least one ground contacting surface.

In some embodiments, the plurality of semi-tubular elements includes an outer wall, an inner wall, a front end, a rear end, a first open side, and a second open side. The first and second open sides permit airflow through the plurality of semi-tubular elements when coupled to the middle layer of the footbed. In some embodiments, the plurality of semi-tubular elements also includes at least one notch that improves the deformation of the plurality of semi-tubular elements to compress under load into the plurality of trough-shaped cavities of the midsole. In some embodiments, the plurality of semi-tubular elements are formed of a polyurethane material.

In some embodiments, the middle layer of the footbed includes a dispersion plate. The dispersion plate has a top surface, and a bottom surface. In some embodiments, the dispersion plate is formed of a material such as plastic, thermoplastic polyurethane, and nylon. In some embodiments, the plurality of semi-tubular elements are coupled to the bottom surface of the dispersion plate. In some embodiments, the bottom surface of the midsole includes a plurality of protrusions that correspond to the plurality of trough-shaped cavities of the top surface of the midsole.

In a preferred embodiment of the invention, a shoe sole including a footbed, a midsole, and an outsole is provided. The footbed has a top layer, a middle layer, and a bottom layer. The top layer of the footbed is an open cell foam material. The middle layer of the footbed is a dispersion plate. The bottom layer of the footbed includes a plurality of deformable, resilient, semi-tubular elements that are arranged transversely to a longitudinal axis of the shoe sole. The plurality of semi-tubular elements are affixed to the bottom surface of the dispersion plate such that the semi-tubular elements protrude downwardly from the dispersion plate to the midsole. The plurality of semi-tubular elements includes an outer wall, an inner wall, a front end, a rear end, a first open side, a second open side, and at least one notch. The at least one notch improves the resilience and deformation of the semi-tubular elements so that they may compress under load into a plurality of trough-shaped cavities of the midsole.

The midsole has a top surface and a bottom surface. The top surface of the midsole includes the plurality of trough-shaped cavities that are arranged transversely to the longitudinal axis of the shoe sole. The plurality of trough-shaped cavities correspond to the plurality of semi-tubular elements such that the semi-tubular elements that protrude downward are received in corresponding trough-shaped cavities of the midsole. The semi-tubular elements will deform under load, providing improved cushioning when the semi-tubular elements are compressed, and also provide a spring effect to return the semi-tubular elements to their default uncompressed state. The semi-tubular elements may have a depth greater than a depth of a corresponding trough shaped cavity whereby the footbed is held in a raised position above the top surface of the midsole. The separation between the lower surface of the footbed and the top surface of the midsole is smaller in forefoot area and greater in the heel area. The separation provides shock absorption and resilience in the shoe because it allows the semi-tubular elements to deform under load and absorb impact shocks as the footbed travels from its raised position, to a compressed position with a lower surface of footbed located against the top surface of the midsole.

The bottom surface of the midsole includes a plurality of protrusions that correspond to the plurality of trough-shaped cavities. Additionally, the outsole includes at least one ground contacting surface.

DETAILED DESCRIPTION OF THE INVENTION

Figure 1:
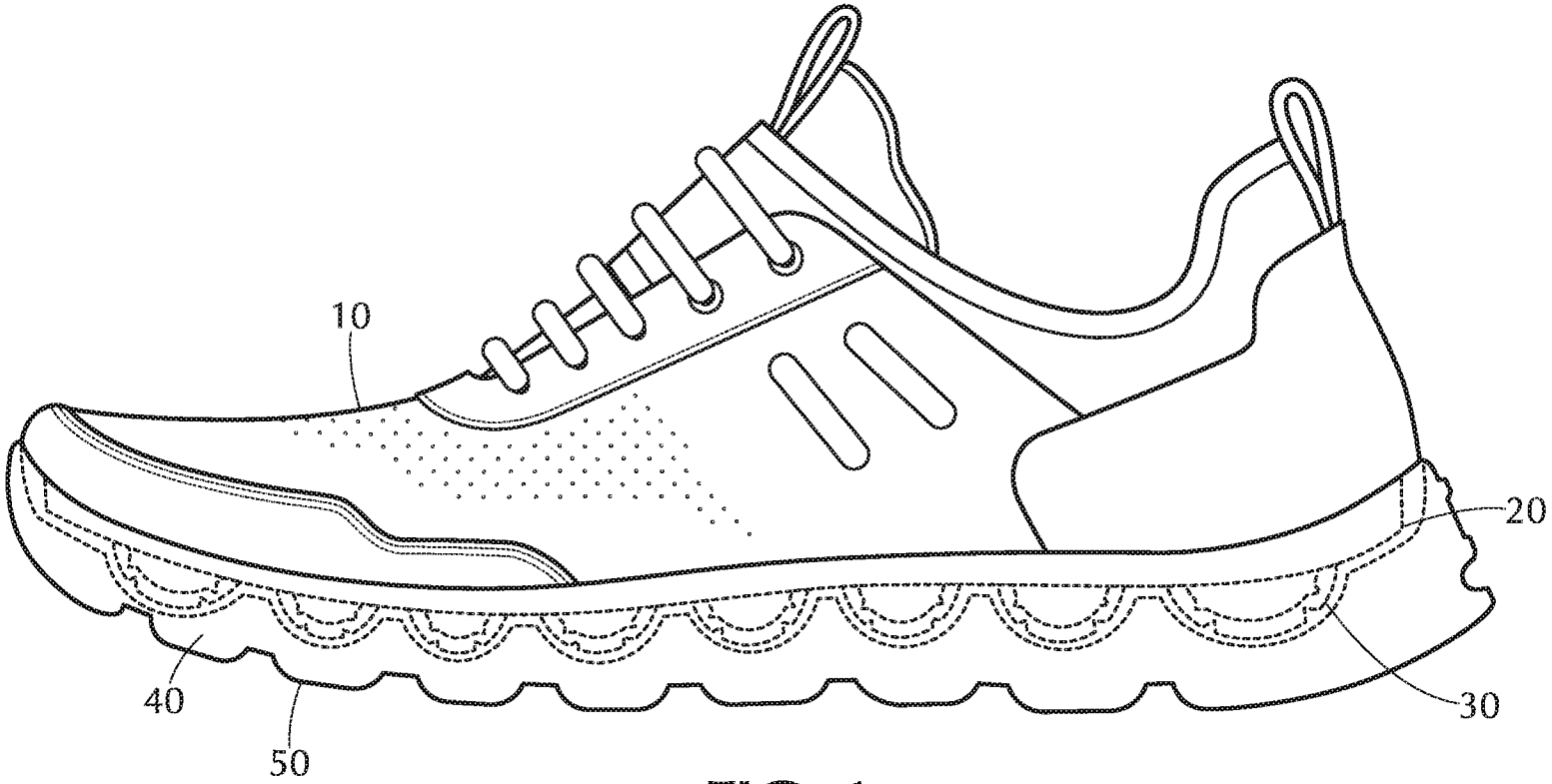
FIG. 1 is a side elevational view of a shoe according to an embodiment of the invention.

The figures show an exemplary embodiment of the invention. Referring to FIGS. 1-8, an exemplary embodiment illustrates a shoe having an upper 10, a footbed 20, a midsole 40, and an outsole 50. The footbed 20 has a plurality of semi-tubular elements 30 that protrude downward and nest in matching cavities 44 in the midsole 40. The footbed 20 and the midsole 40 provide cushioning and energy return to a user performing activities. Such activities include, but are not limited to, standing, walking, running, and jumping.

Figure 3:
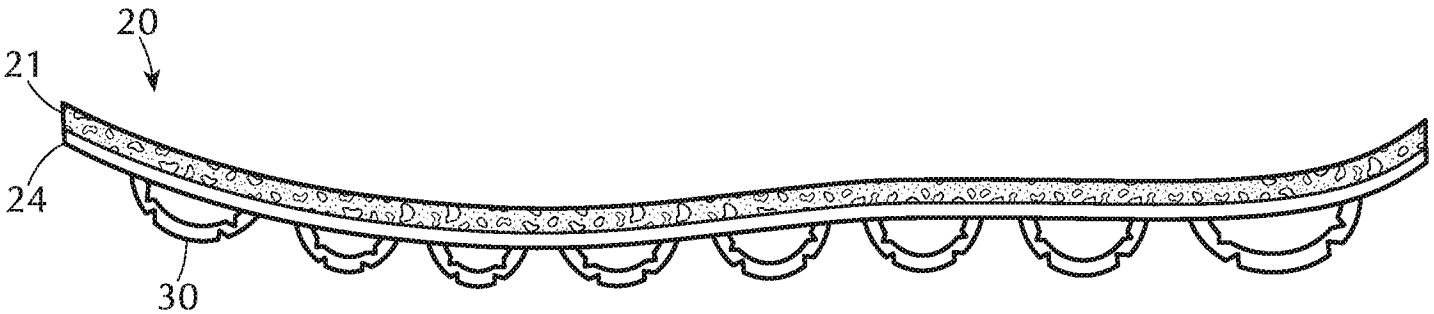
FIG. 3 is a cross-sectional side elevational view of the footbed of FIG. 2 along the line A-A thereof.
Figure 4:
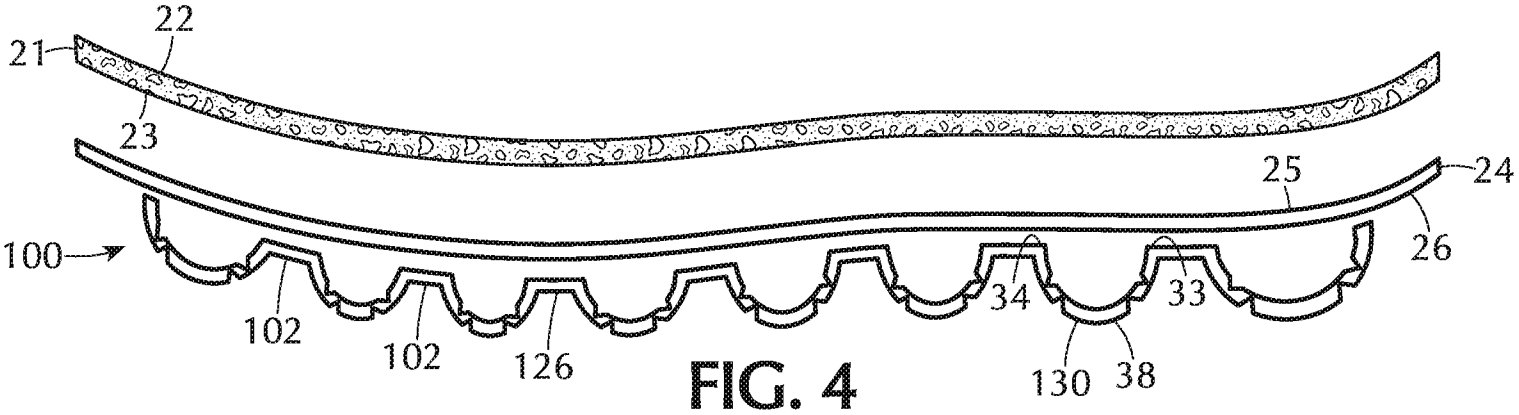
FIG. 4 is an cross-sectional side elevational exploded view of the footbed of FIG. 3.

As shown in FIGS. 3 and 4, the footbed 20 comprises a top layer 21, a middle layer comprising a dispersion plate 24, and a bottom layer comprising the plurality of deformable semi-tubular elements 30. In preferred embodiments, the footbed 20 is shaped so as to contour to the sole of a human foot. In other embodiments, the footbed 20 has a flat, or essentially flat, shape.

FIG. 4 shows an exploded view of the footbed 20 depicted in FIG. 3. The top layer 21 of the footbed 20 has a top surface 22 and a bottom surface 23. The dispersion plate 24 has a top surface 25, a bottom surface 26, and, in some embodiments, a plurality of perforations.

In preferred embodiments, the top layer 21 of the footbed 20 is formed of a slow recovery, open cell foam material that permits airflow through the top layer 21. Polyurethane and/or ethylene-vinyl acetate (EVA) foams may be used for top layer 21. Top layer 21 provides an initial comfortable feel and aeration for a user's foot. The bottom surface 23 of the top layer 21 may simply rest on, or be adhered to, or otherwise coupled to, the top surface 25 of the dispersion plate 24 by any conventional fashion known to those skilled in the art. Such methods may include adhesives, sewing, or welding, either in selected locations, around the perimeter thereof, or more generally.

In preferred embodiments, the dispersion plate 24 is formed of thermoplastic polyurethane (TPU). In some embodiments, the dispersion plate 24 is formed of nylon. In other embodiments, the dispersion plate 24 is formed of another polymer or copolymer material. In some embodiments, the dispersion plate 24 may include or be formed of a three dimensional mesh fabric, which may include voids in the mesh which allow passage of air. The dispersion plate 24 disperses a user's weight evenly across the plurality of semi-tubular elements 30 while also providing aeration for the user's foot.

The semi-tubular elements 30 are open-ended U-shaped tubes that have the upper ends of their "U" shape affixed to the lower surface 26 of dispersion plate 24. The semi-tubular elements are preferably formed from a deformable material. In one embodiment, the semi-tubular elements 30 are formed of ethyl vinyl acetate.

Figure 2:
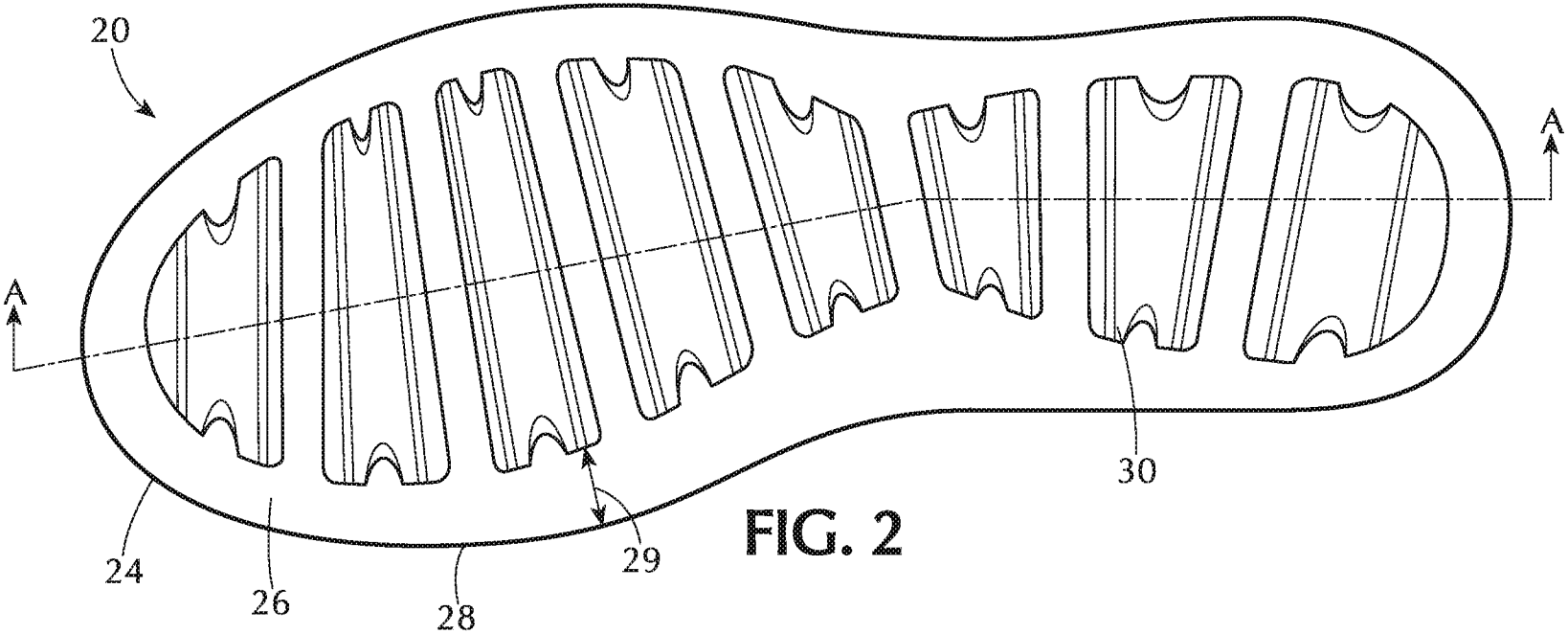
FIG. 2 is a bottom plan view of the footbed of a shoe according to an embodiment of the invention.

The plurality of semi-tubular elements 30 are intermittently placed along a portion of, or the entire length of, the footbed 20. The semi-tubular elements 30 are generally positioned transversely to a longitudinal axis of the shoe sole 10. However, as seen in FIG. 2, the semi-tubular elements 30 may be positioned at various angles with respect to the longitudinal axis of the shoe sole 10. The semi-tubular elements 30 have a lateral width sufficient to span most of the width of the footbed 20. In most embodiments, the semi-tubular elements 30 have a lateral width such that there is a perimeter space 29 of between 5 mm to 15 mm from the ends of the semi-tubular elements 30 to the perimeter 28 of the dispersion plate 24. In some embodiments, the plurality of semi-tubular elements 30 are positioned in only the heel and forefoot regions of the dispersion plate 24. In other embodiments, the plurality of semi-tubular elements 30 are positioned in either the heel region only or the forefoot region only. In preferred embodiments, the semi-tubular elements 30 are located along the entire longitudinal length of the footbed 20.

Figure 5:
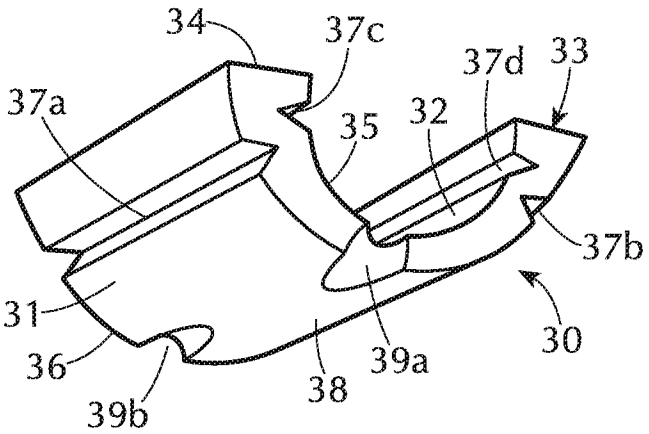
FIG. 5 is a perspective left side, front and bottom view of an embodiment of a semi-tubular element of the footbed of FIG. 2.

FIG. 5 depicts a preferred embodiment of a semi-tubular element 30. Semi-tubular element 30 comprises an outer wall 31, an inner wall 32, a first opening 35, and a second opening 36. Openings 35 and 36 permit airflow through the semi-tubular elements 30.

Semi-tubular element 30 has a front end 34 and a rear end 33 which are connected to the dispersion plate 24. In one embodiment, the semi-tubular element 30 has one or more laterally-extending notches 37*a*, 37*b*, 37*c*, and 37*d* (collectively referred to as notch 37 or notches 37) and apex notches 39*a*, and 39*b* collectively referred to as apex notch 39 or apex notches 39) to improve the resilience and deformation of the semi-tubular element 30. Notches 37 and 39 create crumple zones that, when compressed under load, permit the plurality of semi-tubular elements 30 to collapse and absorb shock. Additionally, notches 37 and 39 allow the semi-tubular element 30 to bounce back to its original state when the compressing load is removed.

Different sized notches 37 and 39 in various locations on the semi-tubular elements 30 can be utilized for improved shock absorption and energy return. On one embodiment, as seen in FIG. 5, the one or more notches 37 extend across the width of the semi-tubular element 30. The one or more notches 37 may include one or more of: notch 37*a* extending across the width of the outer wall 31 between the front end 34 and an apex 38; notch 37*b* extending across the width of the outer wall 31 between the rear end 33 and apex 38; notch 37*c* extending across the width of the inner wall 32 between the front end 34 and an apex 38; notch 37*d* extending across the width of the inner wall 32 between the rear end 33 and apex 38.

Apex notches 39 may include apex notch 39*a* located adjacent the first opening 35 at apex 38, and apex notch 39*b* located adjacent the second opening 36 at apex 38. Apex notches 39 may extend partially across the width of the semi-tubular elements 30 as seen in FIG. 5 or may extend the entire width of the semi-tubular elements 30. Apex notches may be provided in in the inner wall 32, or in the outer wall 31 thereof as seen in FIG. 5.

In preferred embodiments, the plurality of semi-tubular elements 30 are formed of an injection molded ethylene-vinyl acetate material. In other embodiments, the semi-tubular elements 30 are formed of a similarly appropriate material, such as polyurethane, silicone, rubber, thermoplastic rubber, and thermoplastic elastomers.

The semi-tubular elements 30 preferably have varying dimensions depending on their respective positioning along the longitudinal axis of the shoe sole 10. For example, as depicted in FIG. 2, the semi-tubular elements 30 located at the terminal ends of the forefoot and heel regions of the footbed 20 are generally have shorter lateral widths and greater longitudinal lengths than the semi-tubular elements 30 in the middle region of of the footbed 20. The semi-tubular elements 30 located at the terminal ends of the forefoot and heel regions of the footbed 20 may have a rounded forward end and rearward end, respectively. The semi-tubular elements 30 located in the middle region of the footbed 20 generally have greater lateral widths and lesser longitudinal lengths; and preferably have straight sides.

Figure 7:
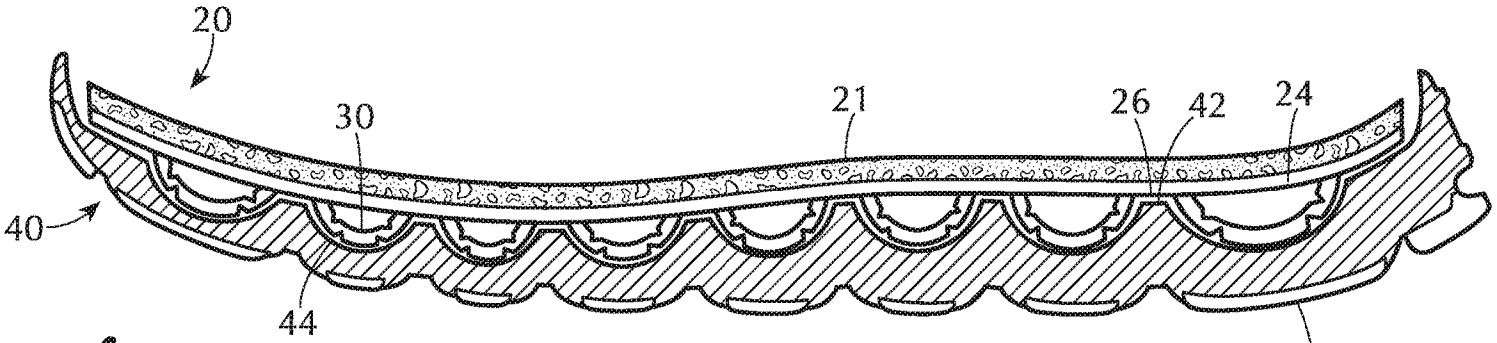
FIG. 7 is a cross-sectional side elevational view of the shoe footbed of FIG. 3 placed in the midsole and outsole of FIG. 6.
Figure 8:
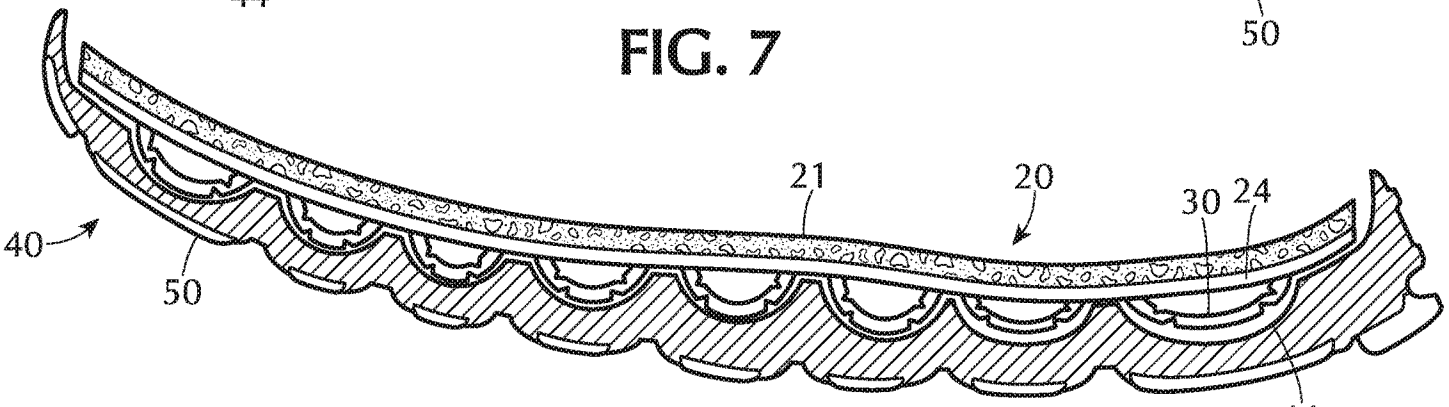
FIG. 8 is a cross-sectional side elevational view of the shoe footbed of FIG. 3 placed in the midsole and outsole of FIG. 6 illustrating deformation of elements thereof when the heel region is compressed under load.

In one embodiment, the plurality of semi-tubular elements 30 are affixed to the dispersion plate 24 by attaching the front end 33 and rear end 34 to the dispersion plate 24 as seen in FIGS. 3, 7 and 8. In such case, the semi-tubular elements 30 are molded to the dispersion plate 24. Other attachment modes may include ultrasonic welding and adhesives. In another embodiment, as seen in FIGS. 4, 9 and 10, the plurality of semi-tubular elements 30 are provided in a molded component 100 that includes a flat plate 102 having a lower surface 126 with semi-tubular elements 130 extending downwardly therefrom.

The plurality of semi-tubular elements 30 coupled to the dispersion plate 24 provide a durable and breathable footbed 20 that provides the necessary support for long-term comfort and stability.

Figure 6:
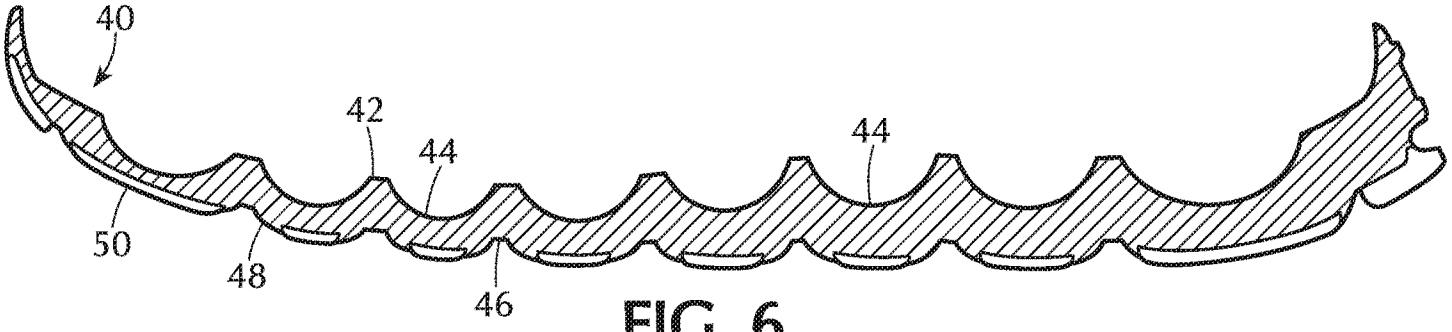
FIG. 6 is a cross-sectional side elevational view of a shoe midsole and outsole adapted to receive the footbed of FIGS. 2-3.

FIG. 6 depicts a preferred embodiment of the midsole 40. In preferred embodiments, the midsole 40 is formed of an ethylene-vinyl acetate material. In other embodiments, the midsole 40 is formed of a similarly appropriate material, such as rubber, polyurethane, and thermoplastic polyurethane. The midsole 40 has a top surface 42 and a bottom surface 46. The top surface 42 comprises a plurality of trough-shaped cavities 44 that are arranged transversely to the longitudinal axis of the shoe sole 10. The plurality of trough-shaped cavities 44 correspond to the plurality of semi-tubular elements 30 such that the footbed 20 is received in the midsole 40 with the semi-tubular elements 30 nesting in the trough-shaped cavities 44. This feature of the semi-tubular elements 30 nesting in the trough-shaped cavities 44 provides a user with a dual durometer feel underneath the foot for improved comfort and support that travels all the way through the outsole 50 to give a more responsive feel to the ground. In preferred embodiments, a small space remains around the semi-tubular elements 30 when seated in the trough-shaped cavities 44, as depicted in FIG. 7. This space allows the semi-tubular elements 30 to deform and fill the space (as depicted in FIG. 8) to better absorb shock when they are compressed under load. The plurality of semi-tubular elements 30 nested in the plurality of trough-shaped cavities 44 in midsole 40 work together to provide the user with cushioning and energy return.

Figure 9:
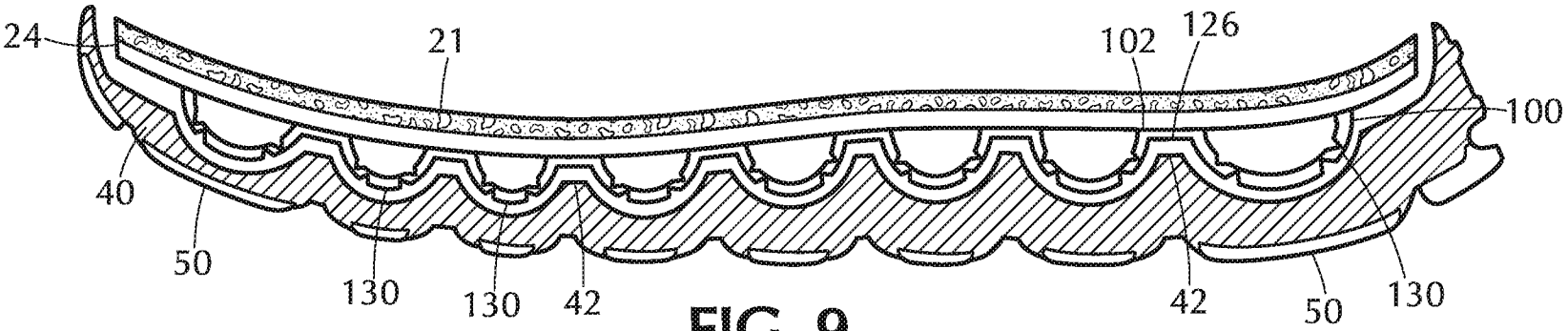
FIG. 9 is a cross-sectional side elevational view of the shoe footbed, midsole and outsole of FIG. 7 showing an alternative embodiment of the shoe footbed where the shoe footbed has a plurality of semi-tubular elements provided in a molded component.
Figure 10:
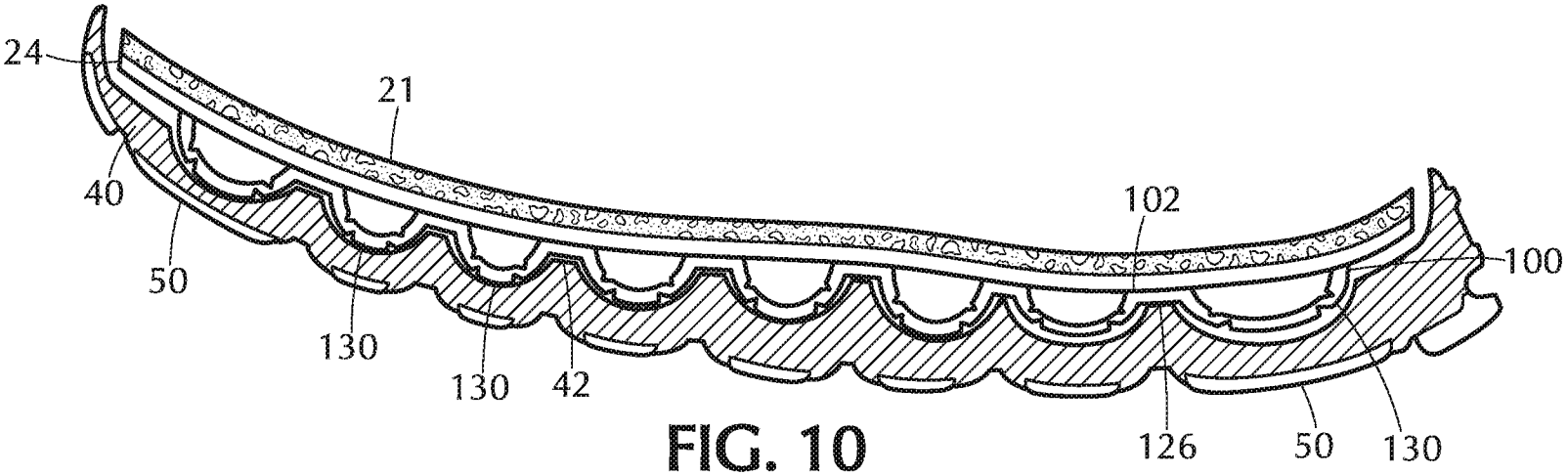
FIG. 10 is a cross-sectional side elevational view of the shoe footbed, midsole and outsole of FIG. 8 showing an alternative embodiment of the shoe footbed where the shoe footbed has a plurality of semi-tubular elements provided in a molded component.

As seen in FIGS. 7 and 8, and more clearly in FIGS. 9 and 10, one or more of the plurality of semi-tubular elements 30 and/or 130 have a depth greater than a depth of a corresponding trough shaped cavity 44, whereby the lower surface 26 and/or 126 of the footbed 20 is held in a raised position above the top surface 42 of the midsole 40, as seen in FIGS. 7 and 9. In one embodiment, the separation between the lower surface 26 and/or 126 of the footbed 20 and the top surface 42 of the midsole 40 in the forefoot area of the shoe is smaller, in a range of 2.0-6.0 mm, and in the midfoot area increases to a range of 3.0-9.0 mm, and in the heel area is largest, in a range of 3.0-12.0 mm. Preferably, the separation between the lower surface 26 and/or 126 of the footbed 20 and the top surface 42 of the midsole 40 in the forefoot area is in the range of 2.5-5.0 mm, and in the midfoot area is in the range of 3.5-6.0 mm, and in the heel area is in the range of 3.5-9.0 mm. The separation between the lower surface 26 and/or 126 of the footbed 20 and the top surface 42 of the midsole 40 in the forefoot area of the shoe provides shock absorption and resilience in the shoe because it allows the semi-tubular elements 30 and/or 130 to deform under load and absorb impact shocks as the footbed 20 travels from its raised position, as seen in FIGS. 7 and 9, to a compressed position with lower surface 26 and/or 126 of the footbed 20 located against the top surface 42 of the midsole 40, as seen in FIGS. 8 and 10.

The shock-absorbing semi-tubular elements 30 and/or 130 are hollow, and when under load or impact, the semi-tubular elements 30 and/or 130 deform with the side walls and apex 38 of their "U" shape buckling and extending into the hollow open space in the center of the semi-tubular elements 30 and/or 130. The semi-tubular elements 30 and/or 130 thereby provide a substantial amount of shock absorption and resilience in the shoe sole while having a light weight due to the generally hollow nature of the semi-tubular elements 30 and/or 130.

In some embodiments, the lower part of the midsole is shaped to conform to the trough-shaped cavities 44. In such embodiments, the bottom surface 46 of the midsole 40 comprises a plurality of protrusions 48. The plurality of protrusions 48 correspond to the plurality of semi-tubular elements 30 and the trough-shaped cavities 44 such that the bottom surface 46 of the midsole 40 generally resembles the shape of the bottom layer of the footbed 20. In some embodiments, the bottom surface 46 of the midsole 40 is differently shaped depending on the shoe's purpose. For example, the bottom surface 46 of the midsole 40 of a casual or business shoe may be generally flat shaped to retain an appropriate look while still providing improved cushioning and energy return to the user.

In preferred embodiments, the outsole 50 comprises at least one ground contacting surface, as shown in FIGS. 1, 6, 7, and 8, and is at least partially formed of a rubber material. In other embodiments, the outsole 50 is formed of a similarly resilient material, such as a durable ethylene-vinyl acetate. In preferred embodiments, each ground contacting surface is formed of a durable material, such as rubber, for improved durability and traction. In some embodiments, the ground contacting surfaces comprise projections that further improve durability and traction.

The outsole 50 couples to the bottom surface 46 of the midsole 40 by any conventional fashion known to those skilled in the art, preferably the outsole 50 is molded and/or adhered to the bottom surface 46. In preferred embodiments, the outsole 50 comprises a plurality of outsole segments embedded in the plurality of protrusions 48 of the midsole 40. In some embodiments, the outsole 50 is generally flat shaped to match a generally flat shaped bottom surface 46 of midsole 40.

Those skilled in the art will appreciate variations of the above-described embodiments that fall within the scope of the invention. Thus, the invention is not limited to the specific examples and illustrations discussed above, but only by the following claims and their equivalents.

What is claimed is:

1. A shoe sole comprising:

a footbed and a midsole;

the footbed having a lower surface having a plurality of deformable semi-tubular elements arranged generally transversely to a longitudinal axis of the shoe sole, the plurality of semi-tubular elements extending downwardly;

the midsole having a top surface provided with a plurality of trough-shaped cavities arranged transversely to the longitudinal axis of the shoe sole, the plurality of trough-shaped cavities corresponding to the plurality of semi-tubular elements;

the footbed being positioned on the midsole with the semi-tubular elements received in the trough-shaped cavities;

one or more deformable semi-tubular elements of the plurality of deformable semi-tubular elements having a depth greater than a depth of a corresponding trough shaped cavity, whereby the lower surface of the footbed is held above the top surface of the midsole.

2. The shoe sole of claim 1, wherein the plurality of semi-tubular elements each having a depth such that when the semi-tubular elements deform to absorb shocks, the lower surface of the footbed is located against the top surface of the midsole.

3. The shoe sole of claim 2, wherein a separation between the lower surface of the footbed and the top surface of the midsole in a forefoot area is smaller and in a heel area is greater.

4. The shoe sole of claim 3, wherein a separation between the lower surface of the footbed and the top surface of the midsole in a forefoot area is in a range of 2.0-6.0 mm.

5. The shoe sole of claim 4, wherein a separation between the lower surface of the footbed and the top surface of the midsole in a forefoot area is in a range of 2.5-5.0 mm.

6. The shoe sole of claim 3, wherein a separation between the lower surface of the footbed and the top surface of the midsole in a midfoot area is in a range of 3.0-9.0 mm.

7. The shoe sole of claim 6, wherein a separation between the lower surface of the footbed and the top surface of the midsole in a midfoot area is in a range of 3.5-6.0 mm.

8. The shoe sole of claim 3, wherein a separation between the lower surface of the footbed and the top surface of the midsole in a heel area is in a range of 3.0-12.0 mm.

9. The shoe sole of claim 8 wherein a separation between the lower surface of the footbed and the top surface of the midsole in a heel area is in a range of 3.5-9.0 mm.

10. The shoe sole of claim 2, wherein one or more of the semi-tubular elements, of the plurality of semi-tubular elements, comprises an outer wall, an inner wall, a front end, a rear end, and a first open side and a second open side permitting airflow through the plurality of semi-tubular elements.

11. The shoe sole of claim 10, wherein one or more of the semi-tubular elements, of the plurality of semi-tubular elements, further comprises at least one laterally-extending notch in the inner wall or the outer wall thereof, the notch increasing the deformation of the semi-tubular elements under load.

12. The shoe sole of claim 10, wherein one or more of the semi-tubular elements, of the plurality of semi-tubular elements, further comprises at least one apex notch in the inner wall or the outer wall thereof, the notch increasing the deformation of the semi-tubular elements under load.

13. The shoe sole of claim 1, wherein the footbed includes a dispersion plate located above the plurality of deformable semi-tubular elements.

14. The shoe sole of claim 13, wherein the footbed includes a cushioning layer above the dispersion plate.

15. The shoe sole of claim 13, wherein the plurality of semi-tubular deformable elements are affixed to a bottom surface of the dispersion plate.

16. The shoe sole of claim 13, wherein the plurality of semi-tubular deformable elements are provided in a molded component that includes a flat plate having a lower surface with semi-tubular elements extending downwardly therefrom.

17. A shoe sole comprising a footbed, a midsole, and an outsole;

the footbed having a top layer, a middle layer, and a bottom layer;

the top layer being a cushioning foam layer having a top surface and a bottom surface;

the middle layer being a dispersion plate having a top surface, and a bottom surface;

the bottom layer including a plurality of deformable semi-tubular elements arranged transversely to a longitudinal axis of the shoe sole and protruding downwardly from the dispersion plate to the midsole, the midsole having a top surface and a bottom surface, said top surface of the midsole comprising a plurality of trough-shaped cavities arranged transversely to the longitudinal axis of the shoe sole, the footbed being positioned on the midsole with the semi-tubular elements received in the trough-shaped cavities;

one or more deformable semi-tubular elements of the plurality of deformable semi-tubular elements having a depth greater than a depth of a corresponding trough shaped cavity, whereby the bottom surface of the middle layer of the footbed is held above the top surface of the midsole;

the bottom surface of the midsole having a plurality of downwardly-extending protrusions arranged transversely to the longitudinal axis of shoe sole and corresponding to the plurality of trough-shaped cavities; and the outsole located on a one or more of the protrusions of the bottom surface of the midsole.

18. The shoe sole of claim 17, wherein the plurality of semi-tubular elements each having a depth such that when the semi-tubular elements deform to absorb shocks, the lower surface of the footbed is located against the top surface of the midsole.

19. The shoe sole of claim 18, wherein a separation between the lower surface of the footbed and the top surface of the midsole in a forefoot area is smaller and in a heel area is greater.

20. The shoe sole of claim 19, wherein a separation between the lower surface of the footbed and the top surface of the midsole in a forefoot area is in a range of 2.0-6.0 mm.

21. The shoe sole of claim 19, wherein a separation between the lower surface of the footbed and the top surface of the midsole in a midfoot area is in a range of 3.0-9.0 mm.

22. The shoe sole of claim 19, wherein a separation between the lower surface of the footbed and the top surface of the midsole in a heel area is in a range of 3.0-12.0 mm.

23. The shoe sole of claim 19, wherein the plurality of semi-tubular deformable elements are affixed to a bottom surface of the dispersion plate.

24. The shoe sole of claim 19, wherein the plurality of semi-tubular deformable elements are provided in a molded component that includes a flat plate having a lower surface with semi-tubular elements extending downwardly therefrom.

25. The shoe sole of claim 19, wherein one or more of the semi-tubular elements further comprises at least one laterally-extending notch a wall thereof, the notch increasing the deformation of the semi-tubular elements under load.

* * * * *